United States Patent [19]

Rohner

[11] 3,974,934

[45] Aug. 17, 1976

[54] RIGID CONTAINER ENCLOSED ON FIVE SIDES

[75] Inventor: Benedikt Rohner, Zurich, Switzerland

[73] Assignee: Spichtig AG Kunststoffwerk Steinen, Steinen, Switzerland

[22] Filed: Mar. 22, 1974

[21] Appl. No.: 453,800

[30] Foreign Application Priority Data

Mar. 23, 1973 Switzerland ..... 4306/73

[52] U.S. Cl. ..... 220/4 F

[51] Int. Cl.[2] ..... B65D 11/16

[58] Field of Search ..... 220/4 F, 62

[56] References Cited

UNITED STATES PATENTS

| | | | |
|---|---|---|---|
| 1,088,864 | 3/1914 | Amundson | 220/4 F |
| 1,655,793 | 1/1928 | McCrery | 220/4 F |
| 3,250,421 | 5/1966 | Braun | 220/4 F |
| 3,349,289 | 10/1967 | Mueller | 220/62 |
| 3,371,816 | 5/1968 | Ricci | 220/4 F |
| 3,432,061 | 3/1969 | Anderson | 220/62 |
| 3,696,960 | 10/1972 | Smirle | 220/4 F |
| 3,759,412 | 9/1973 | Bush | 220/4 F |

*Primary Examiner*—George E. Lowrance
*Attorney, Agent, or Firm*—Oblon, Fisher, Spivak, McClelland & Maier

[57] ABSTRACT

A rigid container enclosed on five sides including a bottom panel, rear panel and top panel to which two side panels are attached, wherein the edges of the container assembly facing the side panels incorporate ribs which engage in slots provided on faces of the side panels, and in which the front exposed edges of the top and bottom panels are provided with a front portion incorporating barb-shaped projections which engage in notches located on the front edges of the side panels.

7 Claims, 11 Drawing Figures

RIGID CONTAINER ENCLOSED ON FIVE SIDES

BACKGROUND OF THE INVENTION

1. Field of the Invention:

The present invention relates generally to rigid containers, and more particularly to an improved rigid container enclosed on five sides.

2. Description of the Prior Art:

Rigid containers enclosed on five sides have been generally known to the prior art and have been used, for example, in the manufacture or furniture, and the packaging industry, for housing instruments, equipment and machines, and as a prefabricated structures in the building trade.

There is a method known to the prior art whereby containers especially furniture cabinets are assembled from a number of separate components. It has been found in the manufacture of such containers of plastics material that high tooling costs are incurred if the container comprises many different component parts. Rigid containers made in one piece have the disadvantage that they occupy a large amount of space during transport and storage.

SUMMARY OF THE INVENTION

Accordingly, it is an object of the present invention to provide a new and improved rigid container wherein the tooling costs are minimized by reducing the number of component parts conventionally utilized for such containers.

Another object of the present invention is to provide a new and improved rigid container enclosed on five sides which is constructed of component parts such that during transport and storage such containers will occupy a minimum amount of space.

A further object of the present invention is to provide a rigid container enclosed on five sides which does not necessitate the use of additional structural components or jointing materials.

Briefly, in accordance with the present invention, the foregoing and other objects are obtained by providing the edges of the container assembly facing the side panels of the container with ribs which engage in slots provided on at least two faces of the side panels. The front exposed edges of the top and bottom panels are also provided with a front portion incorporating barb-shaped projections which engage in notches located in the front edges of the container side panels.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts throughout the several views, and in which.

DETAILED DESCRIPTION OF THE PREFERRED EMBODIMENT

Figure 1A:
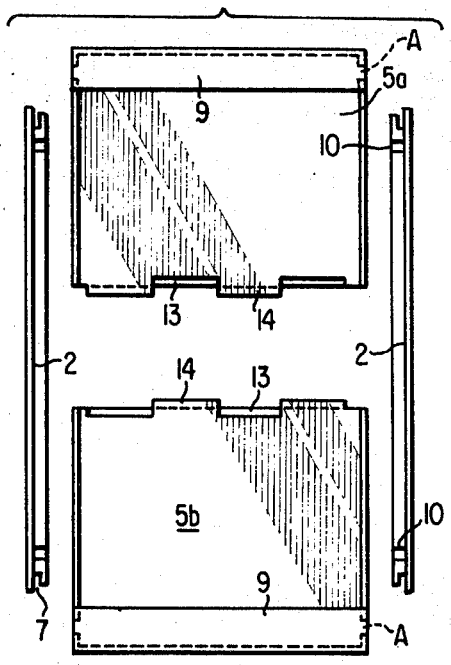
FIG. 1A is an exploded front view of a first embodiment of the present invention.
Figure 1B:
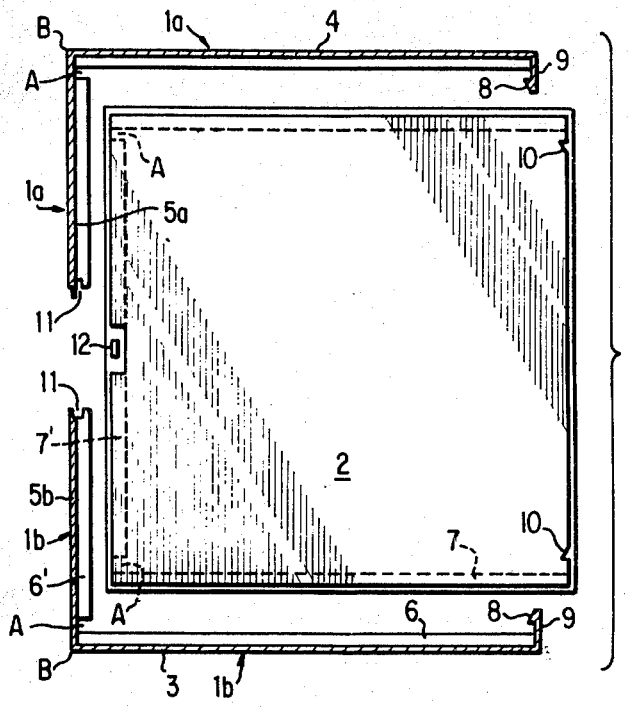
FIG. 1B is an exploded side view of a first embodiment of the present invention.
Figure 1C:
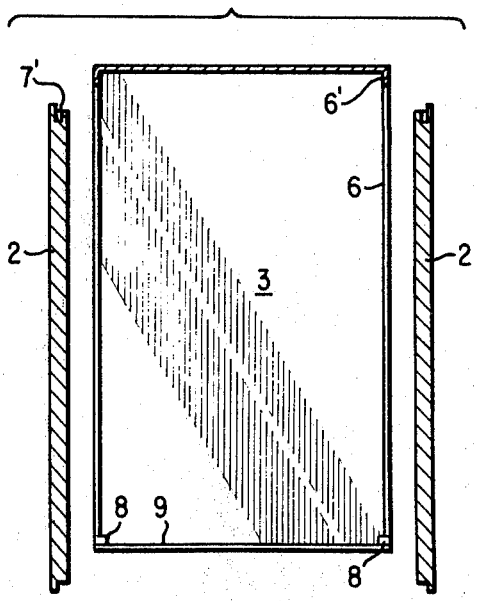
FIG. 1C is an exploded plan view of a first embodiment of the present invention.
Figure 1D:
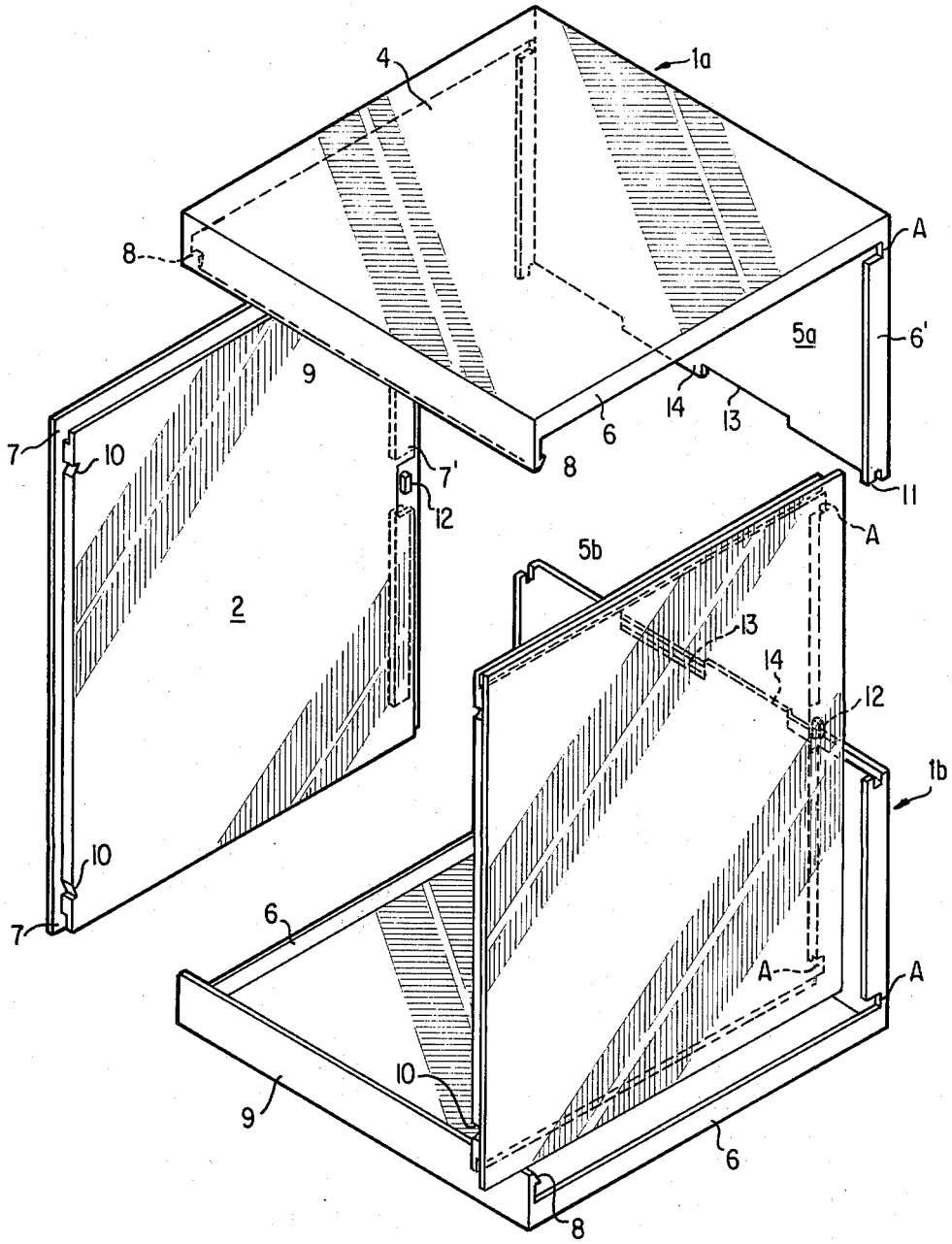
FIG. 1D is an exploded perspective view of a first embodiment of the present invention.

The container assembly includes bottom and top panels 3 and 4 and parts 5*a* and 5*b* of a rear panel and has two identical, angled pieces 1*a* and 1*b*. Two side panels 2, also identical, are adapted to be attached to these pieces 1*a* and 1*b*. The rear panel parts 5*a* and 5*b* abut against each other at their edges, which incorporate cutouts 13 and projections 14. The thickness of these cutouts 13 and projections 14 is, preferably alternately, only half the thickness of rear panel parts 5*a* and 5*b* such that the outer edge of the joint in the rear panel forms a straight line and the rear-panel parts 5*a*, 5*b* are in continuous contact along their interface.

Continuous contact along the interface between angled pieces 1*a*, 1*b* and side panels 2 is assured by providing the edges of angled pieces 1*a*, 1*b* facing side panels 2 with ribs 6, 6' which engage in slots 7, 7' in at least three sides of side panels 2. The ribs 6' on rear panel parts 5*a*, 5*b* and the slots 7' along the rear edges of side panels 2 must be interrupted at least one point so that the side panels 2 can no longer move parallel to slot 7'. These discontinuities are denoted A in FIG. 1. The free ends of the ribs 6' on rear-panel parts 5*a*, 5*b* incorporate recesses 11 which fit against blocks 12 on the side panels 2.

The front exposed edges of the bottom and top panels 3, 4 are provided with a front portion 9 arranged perpendicular to panels 3 and 4. These front portions 9 incorporate barb-shaped projections 8 which engage in notches 10 in side panels 2, thus creating a fixation between side panels 2 and angled pieces 1*a*, 1*b*.

Figure 2A:
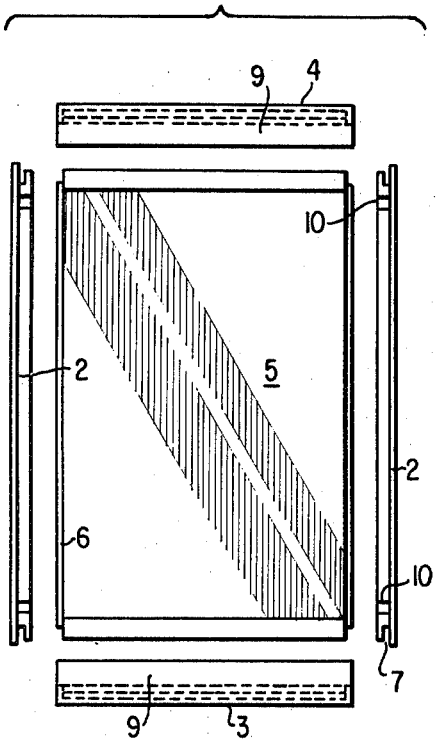
FIG. 2A is an exploded front view of a second embodiment of the present invention.
Figure 2B:
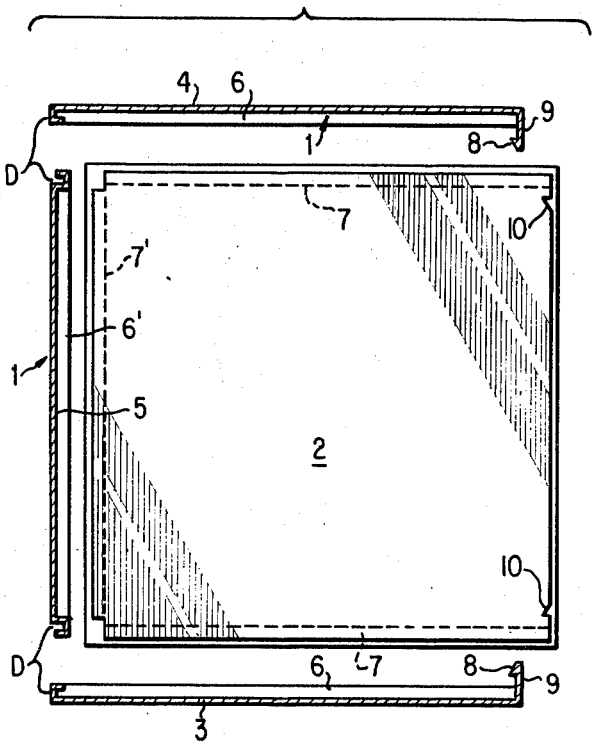
FIG. 2B is an exploded side view of a second embodiment of the present invention.
Figure 2C:
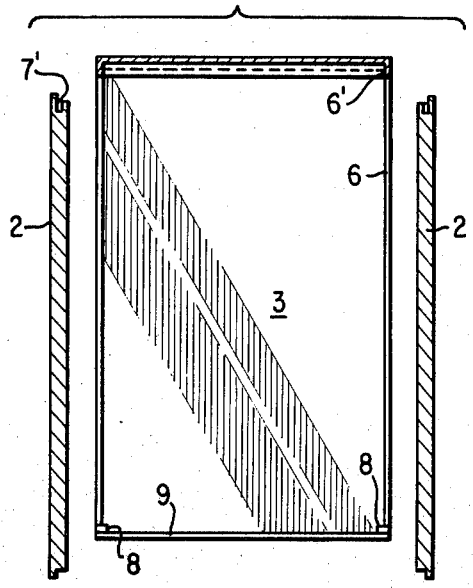
FIG. 2C is an exploded plan view of a second embodiment of the present invention.
Figure 3A:
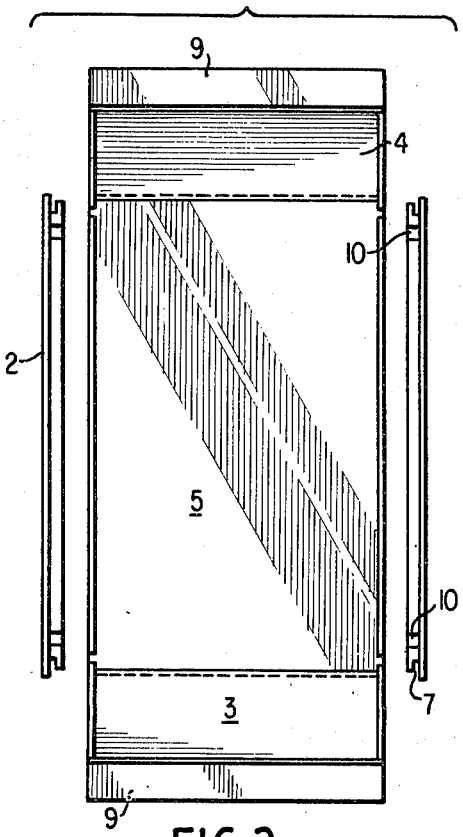
FIG. 3A is an exploded front view of a third embodiment of the present invention.
Figure 3B:
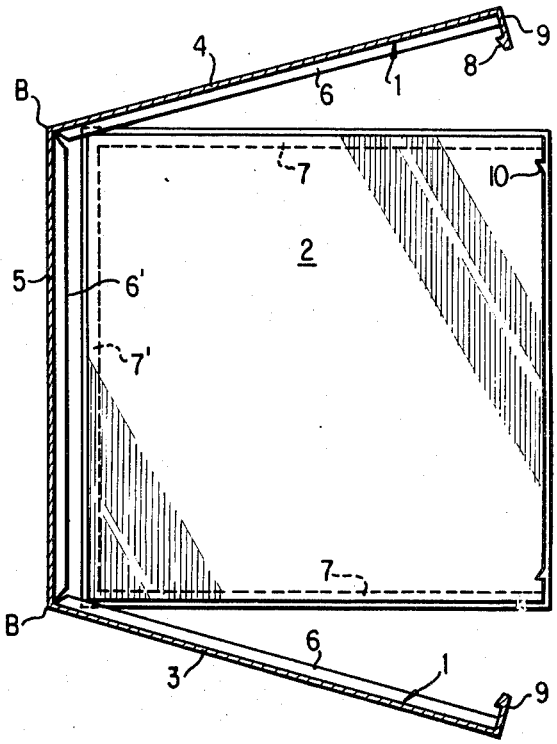
FIG. 3B is an exploded side view of a third embodiment of the present invention.
Figure 3C:
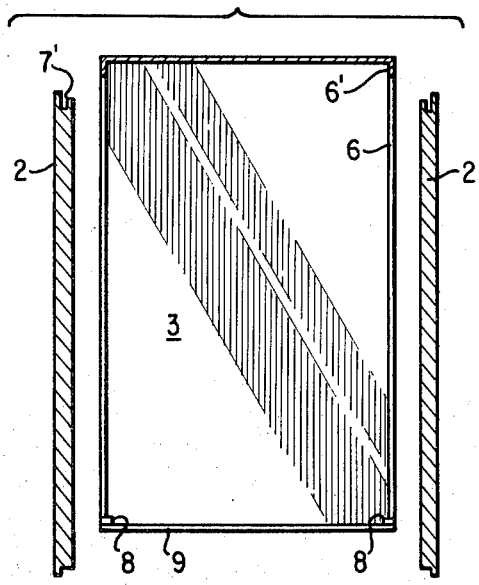
FIG. 3C is an exploded plan view of the third embodiment of the present invention.

The examples illustrated in FIGS. 2 and 3 have the same principal components as that in FIG. 1, the main difference being that in both examples the rear panel 5 is in one piece. The container assembly 1 comprises bottom panel 3, rear panel 5 and top panel 4.

In FIG. 2, the top and bottom panels 3 and 4 are attached to the rear panel 5 by known means D, e.g., interlocking shapes or hinges, whereas this joint in FIG. 3 consists of a flexible link B, e.g., of plastics material. In these two figures, recesses 11, blocks 12 and discontinuities A are not necessary.

Figure 4:
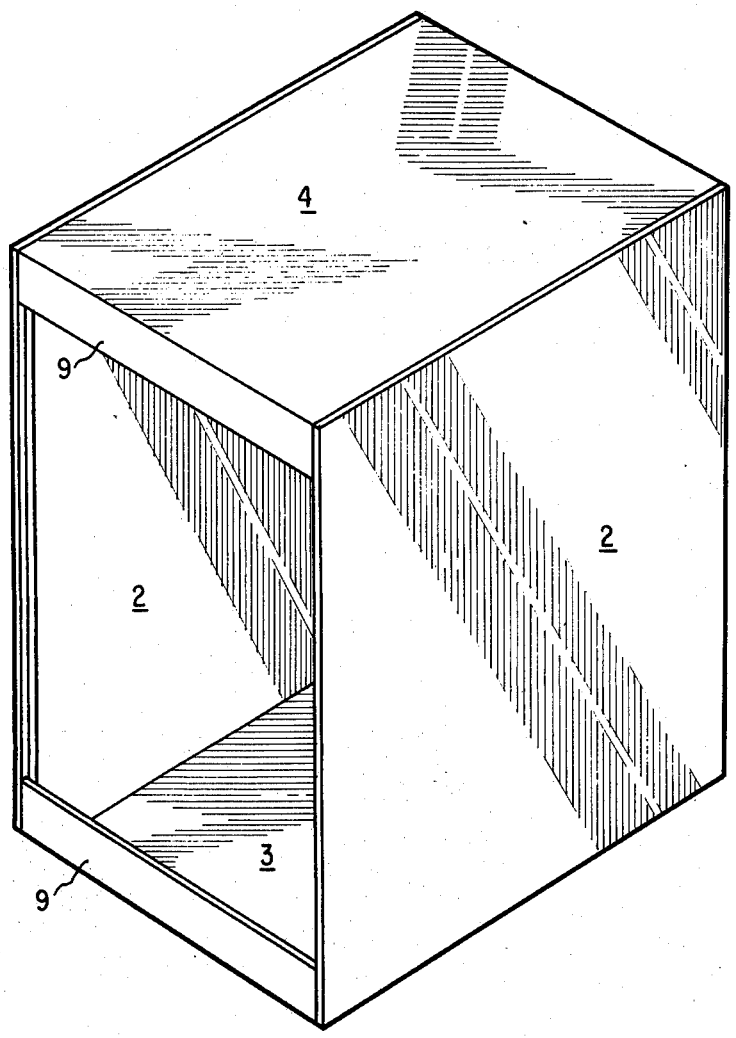
FIG. 4 is a perspective view of the container in the assembled condition.

Finally, FIG. 4 shows a perspective view of an assembled container according to one of the FIGS. 1 to 3.

With all three examples, the joint between rear panel 5 or rear panel parts 5*a*, 5*b* and the bottom and top panels 3 and 4 of the container assembly can be a. rigid, as shown in FIG. 1, b. by means of the configuration shown in FIG. 2, or c. formed by the flexible links B illustrated in FIG. 3.

A combination of the different kinds of joint is also possible.

For the examples shown in FIGS. 2 and 3, the possibility of joining the side panels 2 to the container assembly 1 by means of flexible links, for example, is also not excluded.

The application of the invention is also in other respects not restricted to the examples shown. The two angled pieces 1*a* and 1*b* do not have to be identical as illustrated in FIG. 1. It is also possible to use angled pieces 1*a*, 1*b* having rear-panel parts 5*a*, 5*b* of different lengths so that, with the aid of suitably shaped side panels 2, it is possible to create containers of different sizes.

A number of containers can be joined together at the bottom and/or top panels 3, 4, using known means, e.g., pegs and corresponding holes. If containers are to be joined together at side panels 2, both sides of side panels 2 must be provided with slots 7, 7′ and notches 10. For the version shown in FIG. 1, blocks 12 are then also required on both sides.

If the containers are to be employed in the manufacture of furniture, the panels can be provided on one or both sides with rails to accommodate drawers.

For all the examples, an advantageous method of manufacture is by injection moulding of a thermoplastic plastics material. However, this does not exclude the possibility of making the container wholly or partly of sheet metal, wood, concrete, for example or of any other material.

Obviously, numerous modications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A rigid container assembly enclosed on five sides, comprising:

a bottom panel;

a top panel identical to said bottom panel;

a rear panel integrally formed with and secured to said bottom and top panels, said rear panel comprising two separable sections, one of said sections being rigidly secured to said bottom panel so as to form a first L-shaped member therewith while the other one of said sections is rigidly secured to said top panel so as to form a second L-shaped member therewith; and a pair of identical side panels attachable to and separable from said bottom, top and rear panels, said bottom, top and rear panels being integrally provided with upwardly, downwardly, and forwardly projectng ribs disposed along the side edges thereof, respectively, and the bottom, top and rear peripheral edges of said side panels being provided with slots for mating with and receiving said ribs of said bottom, top, and rear panels, the forward edges of said bottom and top panels also being respectively provided with upwardly and downwardly projecting frame members, disposed parallel to said rear panel, which include rearwardly projecting barb-shaped projections which engage correspondingly configured notches provided within the front edges of said side panels, whereby said container may be fabricated from a minimum number of separate and different components, all of said components being interconnected with each other without the need for additional hardware.

2. A container as set forth in claim 1, wherein:

each of said sections is of the same size, whereby said L-shaped members are identical in structure.

3. A container as set forth in claim 1, wherein:

said sections are of different sizes, whereby the height and size of said container may be selectively varied.

4. A container as set forth in claim 1, wherein:

the abutting surfaces of said rear panel sections are provided with cutout and projection portions which interlock alternately and which are only half the thickness of said rear panel.

5. A container as set forth in claim 1, wherein:

said ribs located upon said rear panel and said slots located upon the rear edges of said panels are discontinuous at at least one point; and the free ends of said rear panel ribs being provided with recesses which are adapted to engage lug blocks formed upon said side panels.

6. A container as set forth in claim 1, wherein:

said rear panel is flexibly and hingedly secured to said top and bottom panels.

7. A container as set forth in claim 1, wherein:

said container is made entirely of plastic.

* * * * *